United States Patent [19]

Schlacht

[11] 4,025,067

[45] May 24, 1977

[54] FEEDER MECHANISM FOR A LABELLING MACHINE

[75] Inventor: Ernst Schlacht, Berlin, Germany

[73] Assignee: Johann Weiss Maschinenfabrik und Apparatebau GmbH, Berlin, Germany

[22] Filed: July 3, 1975

[21] Appl. No.: 593,069

[30] Foreign Application Priority Data

July 4, 1974 Germany ..... 2432433

[52] U.S. Cl. ..... 271/33; 156/568; 156/571; 156/DIG. 30

[51] Int. Cl.[2] ..... B65C 9/12; B65H 3/20

[58] Field of Search ... 156/567, 568, 571, DIG. 29, 156/DIG. 32, DIG. 30, 556; 271/95, 33, 38, 115, 117

[56] References Cited

UNITED STATES PATENTS

| | | | |
|---|---|---|---|
| 2,449,298 | 9/1948 | Hoppe | 156/568 |
| 3,567,559 | 3/1971 | Dullinger | 271/95 X |
| 3,623,720 | 11/1971 | Della Vite | 271/95 |
| 3,682,470 | 8/1972 | Takagi et al. | 271/95 |
| 3,919,040 | 11/1975 | Zodrow | 156/571 |
| 3,923,589 | 12/1975 | Tavernier | 156/568 |
| 3,928,120 | 12/1975 | Zodrow | 156/568 |

*Primary Examiner*—Charles E. Van Horn
*Assistant Examiner*—M. G. Wityshyn
*Attorney, Agent, or Firm*—Strauch, Nolan, Neale, Nies & Kurz

[57] ABSTRACT

A feeder mechanism for a labelling machine to transfer gum from a gumming apparatus to labels at a label supply location, and then to convey the labels to a transfer means. The mechanism includes a feeder member which carries at least one label receiving element mounted on the feeder member by means of a pivot shaft. The feeder member is rotatably driven about an axis and bodily driven in a circular path about a central axis, the feeder member axis being eccentric to said central axis. The pivot shaft is parallel to the rotary axis of its associated feeder member, whereby the movement of the pivot shaft perpendicular to its axial direction describes a looped hypotrochoid. The orientation of each label receiving element about the axis of its pivot shaft is controlled in dependence on the orientation of the feeder member about its rotary axis.

5 Claims, 6 Drawing Figures

FEEDER MECHANISM FOR A LABELLING MACHINE

The invention comparatively to a feeder mechanism for a element machine which transfers gum from a gumming arrangement to labels at a label supply location, and conveys labels from the label supply location to transfer means.

According to the present invention there is provided a feeder mechanism for a labelling machine which transfers gum from a gumming arrangement to labels at a label supply location, and conveys labels from the label supply location to transfer means, the mechanism including a feeder member which carries at least one label receiving element, which is mounted on the feeder member by means of a pivot shaft, the feeder member being drivable about a rotary axis of the feeder member and bodily around a circular path, the pivot axis of the or each pivot shaft being parallel to the rotary axis of the feeder member, whereby the pivot axis of the or each pivot shaft moves in a direction perpendicular to its axial direction and describes a looped hypotrochoid, means being provided to control the orientation of the or each label receiving element about the axis of its pivot shaft in dependence on the orientation of the feeder member about its rotary axis.

A convenient way to afford the rotary and bodily movement of the feeder member is to mount it for free rotation on an eccentric portion of a rotary drive shaft and to provide it with a pinion, coaxial with the eccentric portion, which meshes with an internally toothed annulus which is coaxial with the axis of the drive shaft.

Preferably, the orientation of the or each label receiving element is controlled by a cam plate. This cam plate is arranged to undergo the bodily movement around the circular path with the feeder member, but is arranged so as not to rotate about the rotary axis of the feeder member. The or each pivot shaft carries a cam follower which engages the cam plate and causes the pivot shaft to rock as the feeder member and the cam plate rotate relatively to each other.

The present invention may be carried into practice in a number of ways, but one specific embodiment will now be described, by way of example only, with reference to the accompanying drawings, in which.

Figure 1:
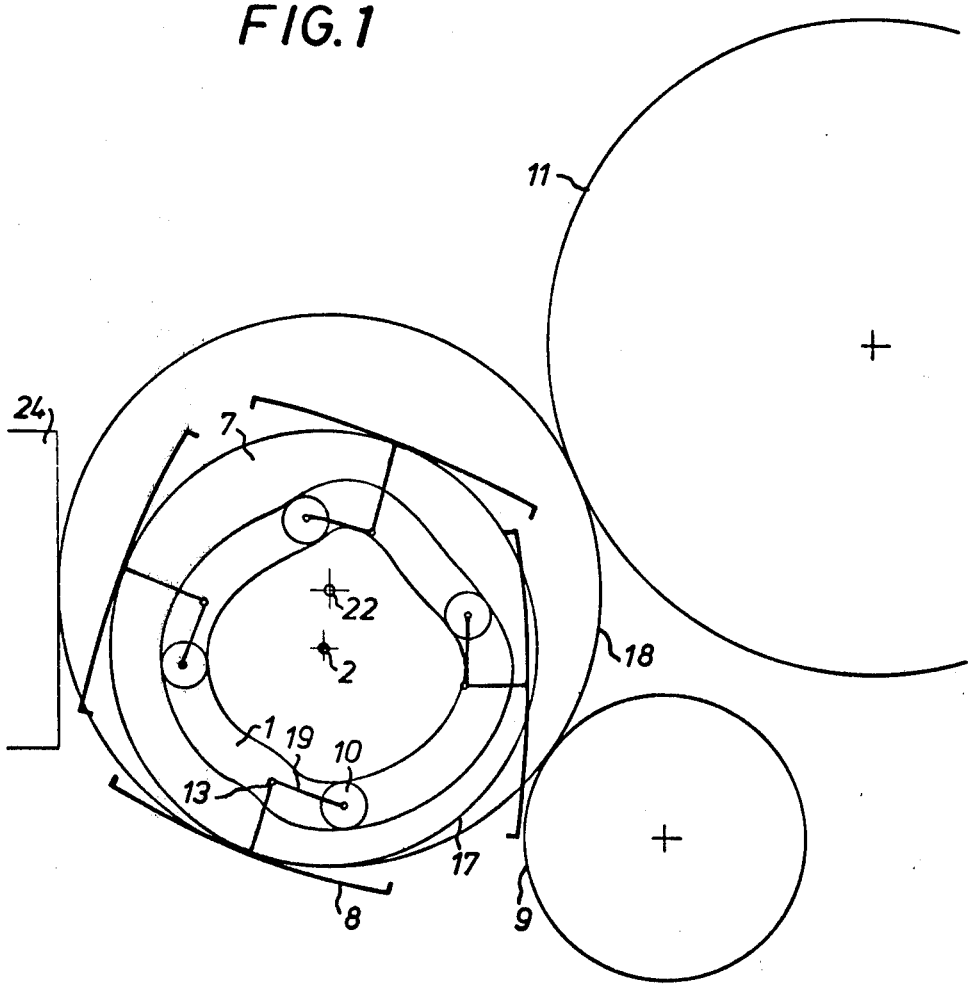
FIGS. 1 to 4 show plan views of a feeder mechanism at different stages during a cycle of operations.

FIGS. 1 to 5 show a feeder mechanism for a labelling machine. This feeder mechanism includes a feeder member comprising a pinion 17, a hub 12 and a circular end plate 25. The feeder member carries four label receiving elements 8 mounted on pivot shafts 13 which are arranged between the pinion 17 and the the end plate 25.

A crankshaft 21 comprises a rotary drive shaft 22, driven by the main drive of the machine, and an eccentric portion 2, which carries the feeder member. The pinion 17 meshes with an internally toothed annulus 18 arranged on the upper edge of a cup-shaped housing 15 of the feeder mechanism, which is fixed in a frame 23 of the labelling machine.

Figure 5:
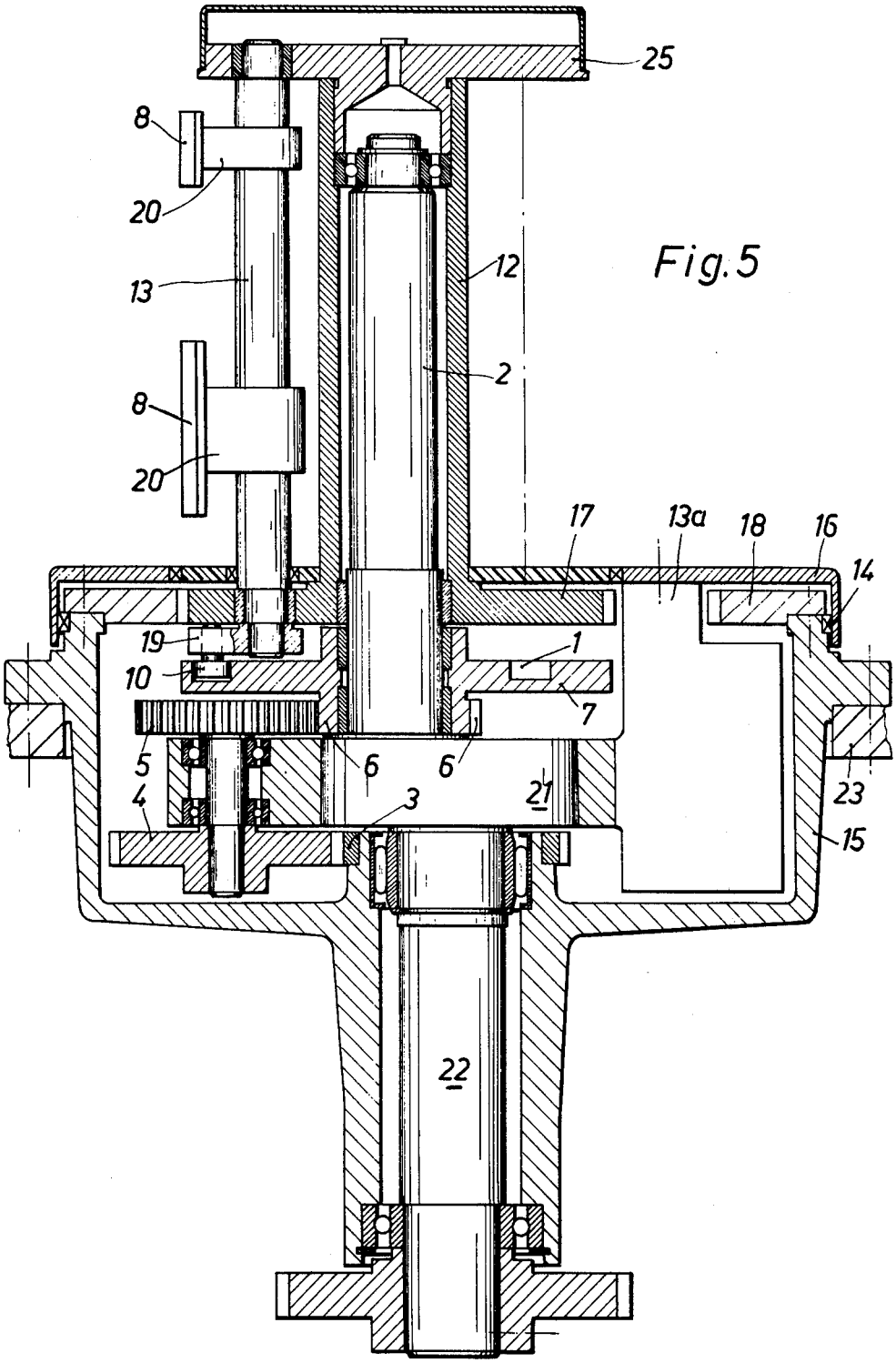
FIG. 5 shows a longitudinal section through the feeder mechanism of FIGS. 1 to 4.
Figure 6:
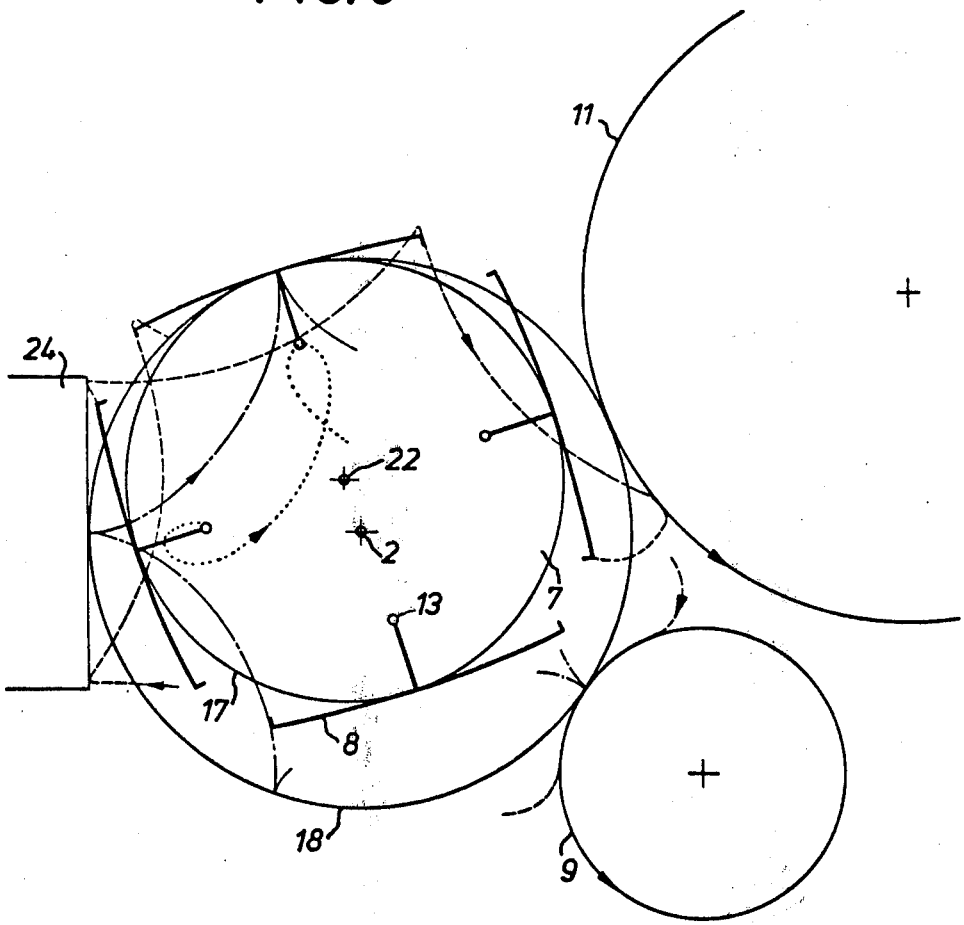
FIG. 6 shows a plan view indicating the paths travelled through by different points of the feeder mechanism.

The feeder member cooperates with a label container 24, a gumming roller 9 and a gripping cylinder 11, which constitutes transfer means for transferring a label from a label receiving element 8 to a bottle to which the label is to be affixed. Each label receiving element 8 includes a label receiving surface which is given a coating of gum by the gumming roller 9. The label receiving surfaces are convex, and have a radius of curvature which is greater than the distance, in the radial direction of the label receiving surface, between a point on the label receiving surface and the rotary axis of the feeder member, which is approximately equal to the pitch radius of the pinion 17. In the embodiment illustrated it is also greater than the pitch radius of the annulus 18. As shown in FIG. 5, the pivot shafts 13 each carry two label receiving elements 8, set one above the other on radial arms 20, for applying front and rear labels to bottles.

The lower ends of the pivot shafts 13 project through the pinion 17 and carry radial arms 19 on which cam followers in the form of rollers 10 are mounted. These rollers 10 run in a groove 1 of a flat, horizontal cam plate 7, which has a central hub enclosing the eccentric portion 2 of the crank shaft 21. The lower end of the hub carries a pinion 6 which engages with a first gear wheel 5 which is fixed for rotation with a vertically running shaft rotatably carried in a radial extension of the crank shaft 21. A second gear wheel 4 is rigidly connected to this vertically running shaft. This gear wheel 4 meshes with a toothed ring 3 which is fixed to the housing 15 and surrounds the drive shaft 22. The transmission ratio between the pinion 6 and the first gear wheel 5 is equal to that between the toothed ring 3 and the second gear wheel 4. This gearing arrangement ensures that the orientation of the cam plate 7 and thus that of the groove 1 remains unchanged relatively to the housing 15 irrespective of the angular position of the crankshaft 21 and thus of the orientation of the feeder member.

The crankshaft 21 is provided with a counterweight **13*a* to counter balance the rotating masses of the gear wheels 4 and 5, the vertically running shaft and the radial extension. This counterweight 13*a* has an arm directed upwards which projects between the annulus 18 and the pinion 17. This arm carries at its upper end a horizontally extending smooth surface, onto which a circular cover 16 is screwed which covers the upper end of the cup-shaped housing 15. The cover 16 is provided with a circular opening which is closed by a further cover through which the hub 12 of the feeder member and the pivot shafts 13 project. The cover 16 has its peripheral edge turned downwards at right angles, with which it encloses a seal 14 attached to the outer side of the upper edge of the housing 15. This arrangement of covers, therefore, whilst following the rotary movement of the pinion 17 cooperates with the housing 15** to keep the gearing assembly of the feeder mechanism constantly sealed from the outside.

Figure 2:
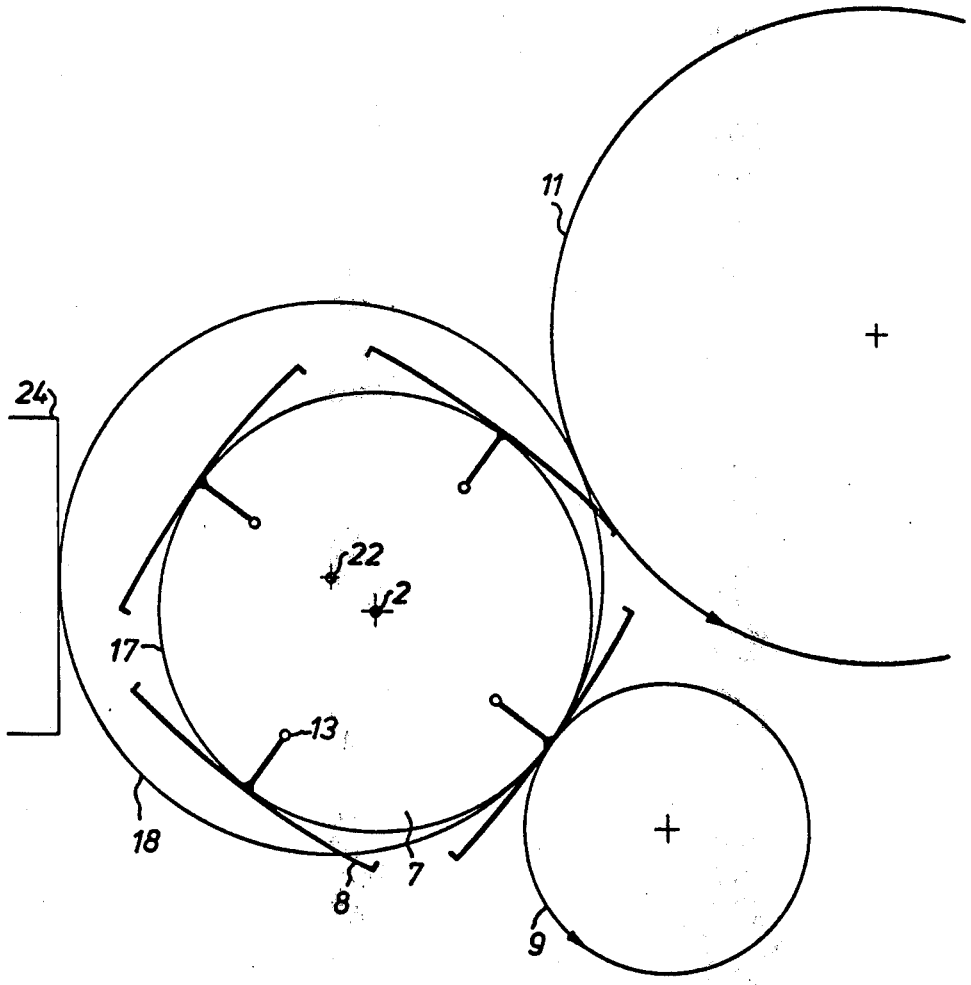
Figure 3:
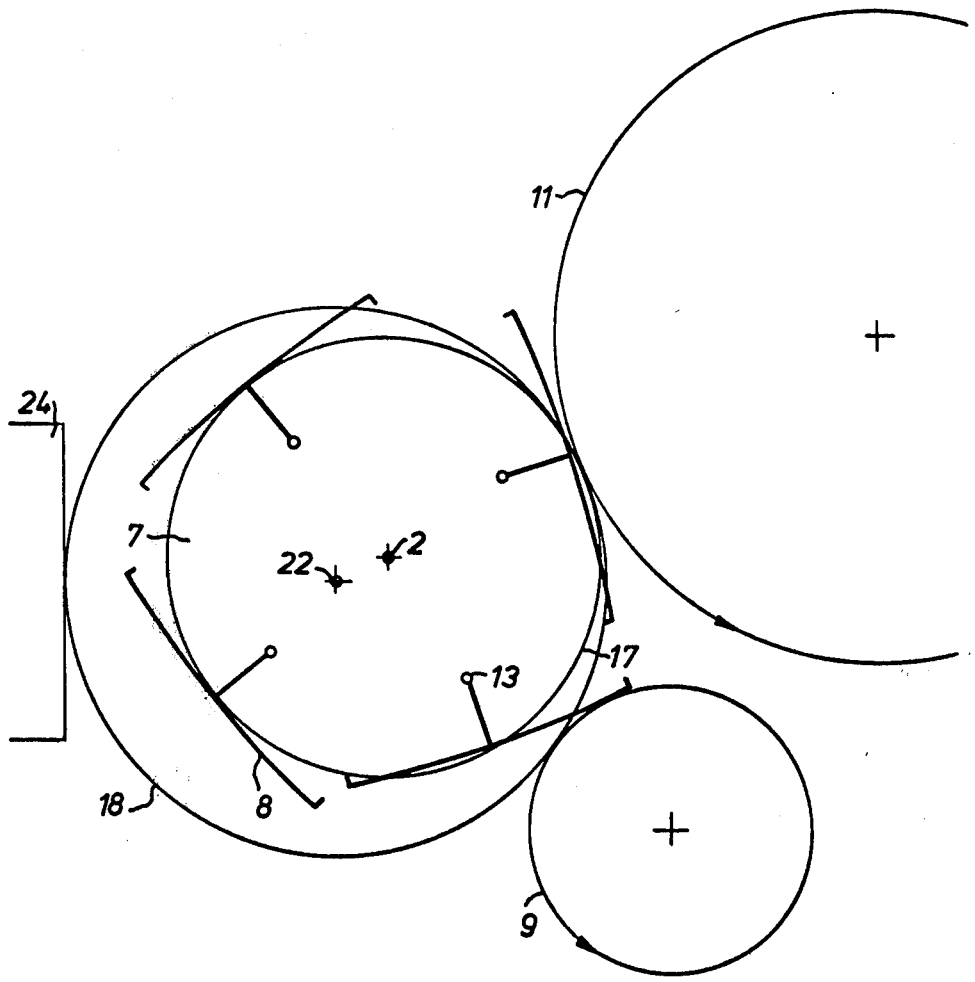

The operation of the feeder mechanism can be seen from FIGS. 1 to 4 and 6. Due to the arrangement of the label receiving elements 8 on the feeder member, the pivot axes of the pivot shafts 13 move in a direction perpendicular to their axial direction and describe a looped hypotrochoid as shown by the dotted line in FIG. 6. Also in FIG. 6, the path of the mid-point of a label receiving element is shown by a dot-dash line and the path of an extremity of a label receiving element is shown by a dashed line. These paths are hypotrochoids upon which have been supermiposed the motion caused by the pivoting of the label receiving elements on their pivot shafts 13. The label container 24, the gripping cylinder 11 and the gumming arrangement in the form of the gumming roller 9 are arranged generally in the regions of the reversal points of the path of the elements 8. The small-stroked pivot movement of the elements 8 controlled by the groove 1 make it possible to apply a coating of gum over the whole area of the label receiving surfaces of the elements 8 as they pass the gumming roller 9 (FIGS. 1 to 3), and to obtain a synchronised path of the elements 8 with a gripper device of the gripping cylinder 11 which is sufficient to transfer reliably even comparatiely small labels from the label receiving elemtn 8 to the gripping cylinder 11 (FIGS. 2 and 3).

Figure 4:
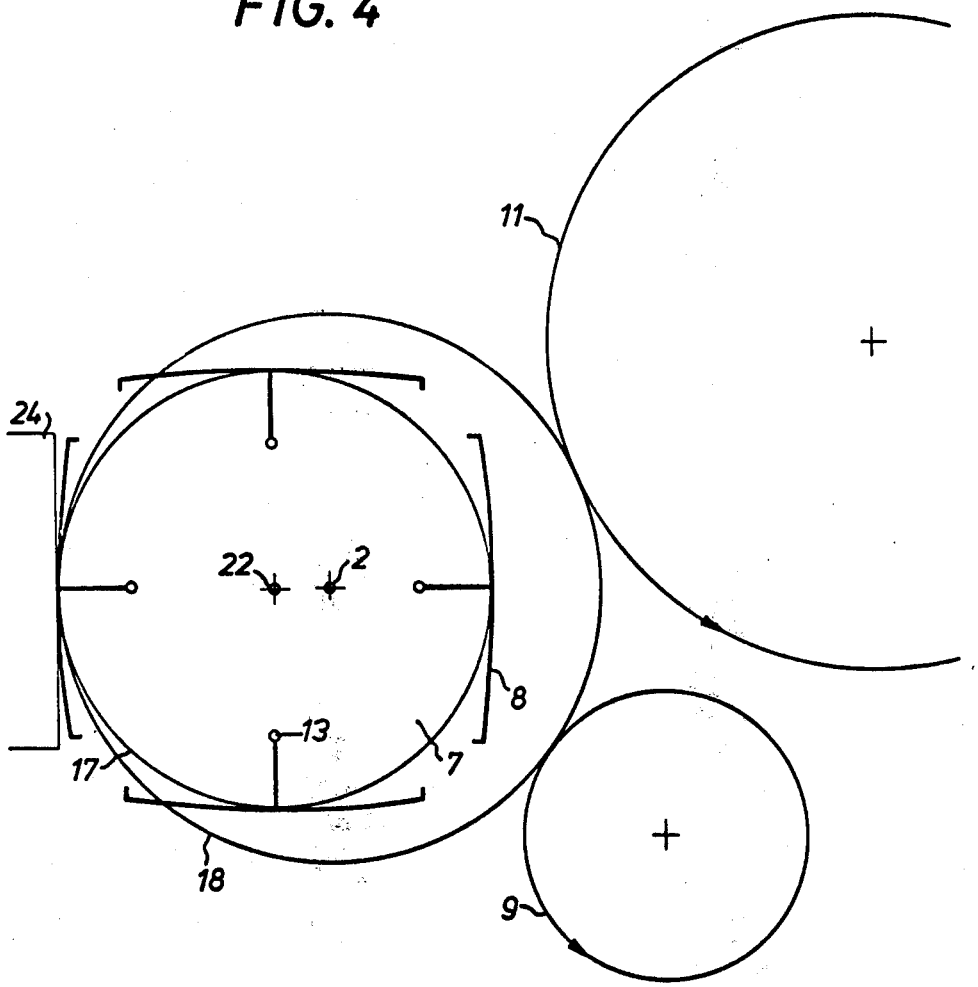

At that reversal point of the hypotrochoid path of a label receiving element 8 which occurs adjacent the label container 24, it is convenient to arrange that the element 8 executes a slight backward movement, relatively to the general direction of movement past the label container 24, so as to extract the uppermost label from under a retaining lip of the container 24. This backward movement can be caused by suitably shaping the groove 1 to pivot the label receiving surface 8 slightly anti-clockwise, as seen in FIG. 4, at the appropriate moment. This backward movement can also be caused by arranging the label receiving element 8 so that its mid-point lies radially inwardly of the pitch circle of the pinion 17, so that this mid-point executes a small loop at its reversal point. The backwards movement so caused can be increased by suitably shaping the groove 1.

The angle through which the label receiving elements 8 pivot relatively to the pinion 17 can be clearly seen in FIGS. 1 and 3, which show approximately the two pivotal end positions of the element 8 as it passes the gumming roller 9. The small size of this angle helps to reduce the mass accelerations of the label receiving elements caused by their changes in direction and speed. This small angle also enables the label receiving elements 8 to be mounted near to each other on the feeder member without the risk of adjacent elements coming into contact with each other as they pivot.

What we claim is:

1. A feeder mechanism for a labelling machine which transfers gum from a gumming arrangement to labels at a label supply location and conveys labels from the label supply location to transfer means, the mechanism including a feeder member which carries at least one label receiving element, which is mounted on the feeder member by means of a pivot shaft, the feeder member being drivable about a rotary axis of the feeder member and bodily around a circular path about a central axis, the pivot axis of said pivot shaft being parallel to the rotary axis of the feeder member, whereby the pivot axis of said pivot shaft moves in a direction perpendicular to said pivot axis axial direction and describes a looped hypotrochoid, means being provided to control the orientation of said label receiving element about the axis of said pivot shaft in dependence on the orientation of the feeder member about the feeder member rotary axis, said orientation control means comprising: a cam plate for controlling the orientation of said label receiving element, said cam plate being mounted to undergo bodily movement around the circular path about said central axis with the feeder member and arranged non-rotatable relatively to the rotary axis of said feeder member, a cam follower on the pivot shaft of said label receiving element, said cam follower engaging said cam plate, whereby rotation of the feeder member about its rotary axis relative to the cam plate causes said pivot shaft to rock.

2. A feeder mechanism as claimed in claim 1, in which said label receiving surface is carried on the free end of a respective first radial arm rigid with the respective pivot shaft, and the cam follower is carried on a second radial arm rigid with the respective pivot shaft and engages a groove in the cam plate.

3. A feeder mechanism as claimed in claim 1, in which, to afford said feeder member rotary and bodily movement, said feeder member is mounted for free rotation on an eccentric portion of a rotary drive shaft and is provided with a pinion secured thereto, the rotary axis of said pinion being coaxial with said eccentric portion and said pinion meshing with a fixed internally toothed annulus mounted coaxial with the axis of the drive shaft, said cam plate being rotationally freely mounted on the eccentric portion of said drive shaft and including a pinion secured thereto and coaxial with said eccentric portion, said cam plate pinion engaging a first gear wheel which is coaxial with and rigidly connected to a second gear wheel by means of a gear shaft, the gear shaft being mounted for rotation about its axis in a radial extension of the drive shaft, the rotary axis of the gear shaft being parallel to and spaced from the rotary axis of the drive shaft, the second gear wheel meshing with a toothed ring coaxial with and fixed relatively to the annulus, the gearing ratio between the toothed ring and the second gear wheel being equal to that between the pinion of the cam plate and the first gear wheel, whereby, when the drive shaft rotates, the cam plate moves bodily with the feeder member, but maintains its orientation about the eccentric portion relatively to the annulus.

4. A feeder mechanism as claimed in claim 3, in which the drive shaft is provided with a counterweight to balance the masses of the radial extension, of the first and second gear wheels and of the gear shaft.

5. A feeder mechanism as claimed in claim 4, in which the counterweight includes an arm which extends between the pinion on the feeder member and the annulus, said counter weight arm carrying a circular cover which has a circular hole which slidingly engages a further circular cover fixed to and coaxial with the feeder member and through which said pivot shaft rotatably extends.

* * * * *

UNITED STATES PATENT AND TRADEMARK OFFICE

CERTIFICATE OF CORRECTION

PATENT NO. : 4,025,067

DATED : May 24, 1977

INVENTOR(S) : Ernst Schlacht

It is certified that error appears in the above-identified patent and that said Letters Patent are hereby corrected as shown below:

Column 1, line 1 delete "comparatively" and substitute --relates--.

Column 1, line 2 delete "element" and substitute --labelling--.

Column 3, line 15 change "elemtn" to --element--.

Signed and Sealed this

*Twentieth* Day of *September 197*

[SEAL]

*Attest:*

RUTH C. MASON
*Attesting Officer*

LUTRELLE F. PARKER
*Acting Commissioner of Patents and Trademarks*